US010022304B2

(12) United States Patent
Deeter

(10) Patent No.: US 10,022,304 B2
(45) Date of Patent: Jul. 17, 2018

(54) AS-NEEDED, TIME CONTROLLED MEDICATION DISPENSER AND METHODS

(71) Applicant: Mark Deeter, Ashland, OH (US)

(72) Inventor: Mark Deeter, Ashland, OH (US)

( * ) Notice: Subject to any disclaimer, the term of this patent is extended or adjusted under 35 U.S.C. 154(b) by 0 days.

(21) Appl. No.: 14/808,564

(22) Filed: Jul. 24, 2015

(65) Prior Publication Data

US 2016/0022543 A1 Jan. 28, 2016

Related U.S. Application Data

(60) Provisional application No. 62/028,827, filed on Jul. 25, 2014.

(51) Int. Cl.
*A61J 7/04* (2006.01)
*A61J 7/00* (2006.01)

(52) U.S. Cl.
CPC ..... *A61J 7/0427* (2015.05); *A61J 7/0076* (2013.01); *A61J 7/0418* (2015.05); *A61J 7/0445* (2015.05); *A61J 2200/30* (2013.01)

(58) Field of Classification Search
CPC ..... A47K 10/421; B65D 75/5855; B65D 83/0805; G07D 11/0006; G07D 11/0012
See application file for complete search history.

(56) References Cited

U.S. PATENT DOCUMENTS

| | | | |
|---|---|---|---|
| 5,036,462 | A | 7/1991 | Kaufman et al. |
| 6,438,451 | B1 | 8/2002 | Lion |
| 7,044,302 | B2 | 5/2006 | Conley |
| 7,743,923 | B2 | 6/2010 | Conley |
| 7,896,192 | B2 | 3/2011 | Conley et al. |
| 7,996,106 | B2 | 8/2011 | Ervin |
| 2010/0305750 | A1 | 12/2010 | Conley |

*Primary Examiner* — Leslie A Nicholson, III
*Assistant Examiner* — Kelvin L. Randall, Jr.
(74) *Attorney, Agent, or Firm* — Hahn, Loeser & Parks LLP

(57) ABSTRACT

A medication dispenser having a housing adapted to securely retain patient medication until such a time as a controller enables a patient interface to permit a patient to access medication stored and distributed by the dispensing assembly.

11 Claims, 12 Drawing Sheets

AS-NEEDED, TIME CONTROLLED MEDICATION DISPENSER AND METHODS

CROSS-REFERENCE TO RELATED APPLICATIONS

This U.S. patent application claims priority to U.S. Provisional Patent Application Ser. No. 62/028,827, filed on Jul. 25, 2014, which is incorporated herein by reference in its entirety.

BACKGROUND

Pain control is a major part of patient treatment in the medical field. For most patients, this is achieved via medication. It is of the utmost importance to ensure that the proper medication is received by the patient according to the instructions of the prescribing doctor and/or pharmacist. When a patient is in a hospital or assisted-care facility, the physicians, nurses and/or staff monitor the doses of medication given to a patient. When a patient is removed from those settings and care is provided at the home, the task may fall to family members or visiting nurses hired for the job. In many instances, the patient does not require round the clock care but requires assistance for specific tasks such as taking medication.

For example, it can be quite difficult for a patient with dexterity issues to manipulate and remove the correct dosage from traditional medication containers. Additionally, patients with memory loss, or those who suffer from degenerative disorders like Parkinson's or Alzheimer's, may have difficulty in adhering to prescription instructions with respect to the timing and prescribed dosage of their medication. Patient caregivers, while capable of helping with most daily tasks or activities, may have their own dexterity issues that prevent easy handling of patient medication, or may consist of a team of caregivers or family members who do not come at consistent times or may not have the requisite training or monitoring capabilities necessary to ensure timing and dosage requirements for patient medication are followed.

Traditional medication containers also provide insufficient safeguards to: prevent persons other than the patient from accessing the medications contained therein; protect against accidental or intentional overdose; and minimize the risk of addiction. Indeed, traditional medication containers provide the prescribing physician or pharmacist with absolutely no feedback on the patient's use, or abuse, of medications. Nor do traditional medication containers permit physicians to continue to prescribe necessary medications under strictly controlled circumstances to those persons suffering from addiction to the pills, or provide a mechanism that is capable of gradually treating addicts by reducing dispensed amounts of medication over time.

In these, and other, situations, a need is felt for a medication (also referred to interchangeably as "pill") dispenser that can hold a large amount of medication and solves the aforementioned problems in the art by dispensing medication to patients at predetermined times, and/or if necessary on an as-needed basis, in a safe and secure manner.

Further limitations and disadvantages of conventional, traditional, and proposed approaches will become apparent to one of skill in the art, through comparison of such systems and methods with embodiments of the present invention as set forth in the remainder of the present application with reference to the drawings.

SUMMARY

Embodiments of the present invention provide a medication dispensing apparatus that securely stores and dispenses patient medication under strictly controlled prescription instructions.

One advantage of embodiments of the present invention is providing a medication dispensing apparatus that has safeguards preventing the dispensing of patient medication to unauthorized persons.

Another advantage of embodiments of the present invention is providing a medication dispensing apparatus that is adapted to dispense medication on an as-needed time controlled basis.

Embodiments of the present invention provide a medication dispensing apparatus that can be refilled and monitored by caregivers, without the patient having access to medication except as dispensed under controlled conditions.

Yet other advantages of embodiments of the present invention include providing a medication dispenser that can reduce patient intake of prescribed medication by increasing the duration between controlled medication dispensing events.

One advantage of embodiments of the present invention include providing a medication dispenser that can confirm patient compliance with prescription instructions by recording, via images and/or data records, a dispensing history.

In one embodiment of the invention, a medication dispenser may comprise a housing adapted to securely retain patient medication and be selectively accessible by a caregiver, a dispensing assembly situated within the housing and selectively accessible by a caregiver for medication refill, a controller situated within the housing and in operative communication with the dispensing assembly and selectively accessible by a caregiver, and a patient interface adapted to dispense medication to the patient. In this embodiment, the controller is inaccessible to the patient and adapted to activate the patient interface for dispensing of medication according to caregiver instructions.

In another embodiment of the invention, an as-needed time controlled medication dispenser may comprise a housing adapted to securely retain patient medication and be selectively accessible by a caregiver, wherein the housing has a top cover and locking mechanism adapted to selectively retain the top cover in a closed position. The embodiment may also have a dispensing assembly, situated within the housing and selectively accessible by a caregiver for medication refill, which comprises a support plate with a drop chute feed hole, a pill reservoir disk with a plurality of medication retention slots operatively seated onto the support plate, a drive motor and a pill drop chute situated below the drop chute feed hole. The embodiment may also have a controller, situated within the housing and selectively accessible by a caregiver, comprising a caregiver interface mounted to the support plate, a top cover sensor, one or more disk position sensors, a motor controller, a safety relay, one or more wireless electronic signal communications modules, a motor controller decoder and a camera. The embodiment may also have a patient interface that only dispenses medication to a patient after a predetermined password is entered. The embodiment may also operate in a manner wherein the controller is inaccessible to the patient, and activates the patient interface after a predetermined time period has elapsed.

In another embodiment of the invention, a method for providing as-needed time interval controlled dispensing of patient medication may comprise the following steps. First, providing an apparatus comprising a housing, a dispensing assembly, a controller and a patient interface, wherein the dispensing assembly and controller are inaccessible to the patient but selectively accessible to a caregiver. Second, providing a caregiver with patient medication and means for accessing the dispensing assembly and controller. Third, filling the dispensing assembly with patient medication. Fourth, programming the controller to dispense medication to a patient according to caregiver selected procedures. Fifth, providing a patient with means to activate the patient interface. Sixth, dispensing medication to the patient after a predetermined time interval has elapsed and the patient has activated the patient interface. And seventh, resetting the predetermined time interval for continuous medication dispensing according to steps one through six.

These and other advantages and novel features of the present invention, as well as details of illustrated embodiments thereof, will be more fully understood from the following description and drawings.

DETAILED DESCRIPTION

Figure 1:
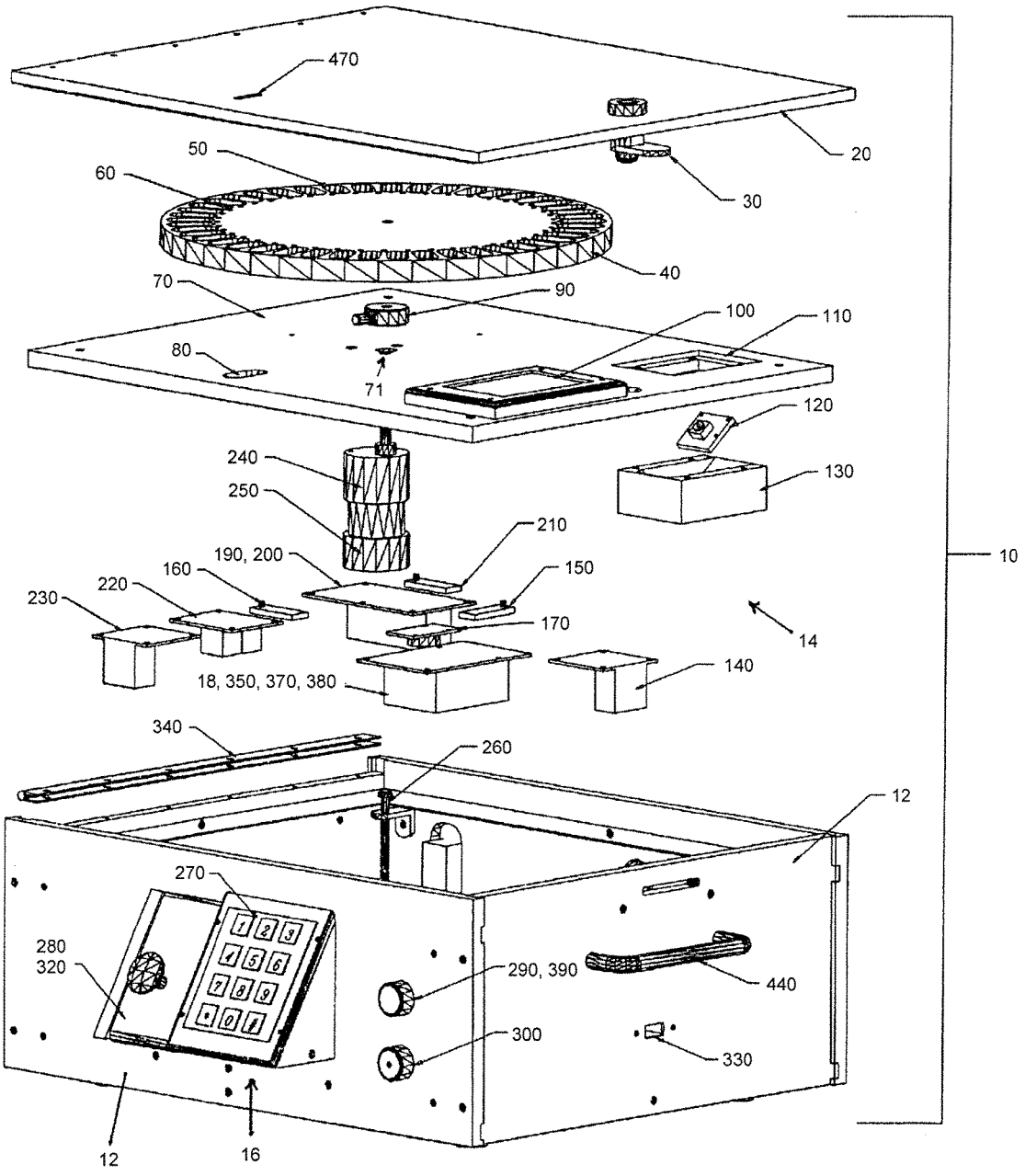
FIG. 1 illustrates an exploded top front and side angle perspective view of a medication dispenser according to one embodiment of the invention.

FIG. 1 illustrates an exploded plan view diagram of an example embodiment of a medication dispenser 10. The medication dispenser 10 includes various components and subassemblies that are operationally connected, as is well known to persons of ordinary skill in the art and further described below, to effectuate the dispensing of medication to a patient according to selected medication prescription parameters. The medication dispenser 10 may consist of, at least, a housing 12, dispensing assembly 14, patient interface 16 and controller 18. Broadly speaking, the housing 12 securely retains patient medication until such a time as the controller 18 enables the patient interface 16 to permit a patient to access medication stored and distributed by the dispensing assembly 14.

With continuing reference to FIG. 1, the housing 12 is designed to securely retain patient medication until it is ready to be dispensed to a patient, with the coordination of other device components, under controlled circumstances. This purpose is achieved by making medication available to the patient under certain circumstances, further described below, without permitting the patient to access the medication dispensing assembly 14 and controller 18 retained within the housing 12. Medication refills, and other programming and monitoring actions, are achieved by making the dispensing assembly 14 and controller 18 contained within the housing 12 selectively accessible by a caregiver (broadly defined to be a physician, pharmacist, nurse, home health aide, family member or other such person charged with assisting in the proper dispensing of patient medication).

In one embodiment, shown in FIG. 1, the housing 12 may comprise a rectangular box (although any other shape could be selected, according to the preferences of a person skilled in the art) with a top cover 20 that can prevent access to the interior of the housing 12 while also being selectively removable by a caregiver. The top cover 20 may have a locking mechanism 30 that keeps it from being removed or opened. The locking mechanism 30 may comprise a lock and key arrangement, as is known in the art. The top cover may be entirely removable from the housing 12, or may be hingedly attached to the housing 12 by virtue of being operatively attached to a top cover hinge 340 in a manner that permits opening of the top cover 20 as if it were a door. The top cover 20 may be secured to the top cover hinge 340 with anti-tamper screws 260, or other such fasteners designed to prevent a patient from gaining unauthorized access to the housing 12 interior. The housing 12 may also have ports 360, vents 430 or other openings, adapted to provide venting, mounting, or access to the interior of the housing 12. The housing 20 may also have one or more of a handle 440, bottom feet 460 or end feet 450 configured to assist in the transport and safe positioning of the medication dispenser 10. The housing 12 may have a repair cover 480. The housing 12 securely retains apparatus subassemblies such as the controller 18 and dispensing assembly 14.

Figure 2:
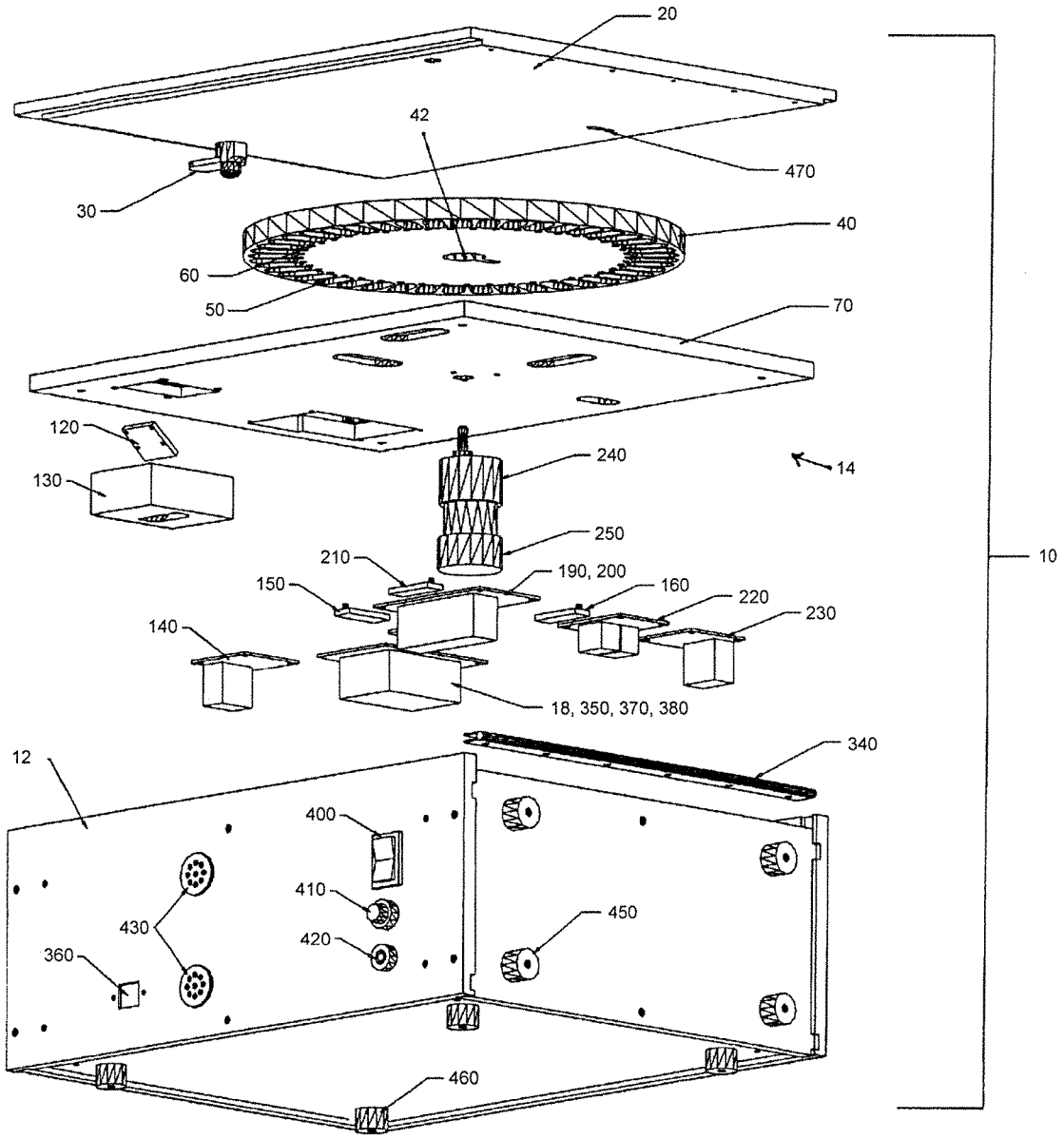
FIG. 2 illustrates an exploded bottom rear and side perspective view of a medication dispenser according to one embodiment of the invention.

The dispensing assembly 14 is configured to store patient medication until such a time as signals from the controller 18, and/or patient interface 16, prompt a medication dispensing event. As shown in FIGS. 1-2, the dispensing assembly 14 may comprise one or more of a support plate 70, pill reservoir disk 40 and pill drop chute 280. The support plate 70 may be of a shape corresponding to the interior of the housing 12, and is operatively seated within the interior of the housing 12 so as to provide a cover to the various components (motor, sensors, etc.) located below, and to provide a foundation for mounting of the pill reservoir disk 40 and other components. The support plate may have an aperture for 71 for receipt of an axle associated with an associated disk drive motor 240, and holes for mounting to the housing 12. The support plate 70 may have one or more drop chute feed holes 80.

The pill reservoir disk 40 is operatively seated onto the top of the support plate 70. The pill reservoir disk 40 has a plurality of disk slots 50, consisting of a series of holes in the pill reservoir disk 40 that roughly correlate in size to the support plate's drop chute feed holes 80, that are configured to accept patient medication such as pills. When the pill reservoir disk 40 is operatively attached onto the top surface of the support plate 70, and the top cover 20 of the housing 12 secured, patient medication contained in the disk slots 50 is stored in a substantially fixed position, with the top cover 20 and support plate 70 keeping the pills within the disk slot 50. Rotation of the pill reservoir disk 40, in either a clockwise or counter-clockwise motion, results in movement of patient medication. When a disk slot 50 is moved into a position aligned above a drop chute feed hole 80, gravity causes medication contained within the disk slot 50 to fall out of the pill reservoir disk 40 and into the pill drop chute 280. The pill drop chute 280 is positioned below the drop chute feed hole 80 so that it captures pills vacated from the pill reservoir disk 40 and moves said medication into a position accessible to the patient (although other dispenser components may have to be manipulated before final receipt of pills can be achieved). In one embodiment, the top cover 20 may have a disk slot clear opening 470 that aligns with the drop chute feed hole 80 and disk slot 50 so that medication that becomes lodged or otherwise fails to fall out of the pill reservoir disk 40 may be forced down into the pill drop chute 280. The pill reservoir disk 40 may also have a recess 42 adapted to receive a disk drive hub 90 that is adapted to operatively attach to an associated motor 240 for easy assembly, disassembly and precise rotation of the pill reservoir disk 40.

In one embodiment, the support plate 70 may have two pill drop chute holes 80*a*, 80*b* while the pill reservoir disk 40 may have two series of disk slots 50*a*, 50*b*; the second pill drop chute hole 80*b* may be adapted to remain closed while medication contained in the first series of disk slots 50*a* is emptied through the first drop chute hole 80*a*; when medication in the first series of disk slots 50*a* are emptied, the second pill drop chute hole 80*b* may be adapted to open, thereby permitting dispensing of medication contained in the second series of disk slots 50*b*; in this way, the amount of medication that can be stored and dispensed in between refill events is increased.

Figure 3:
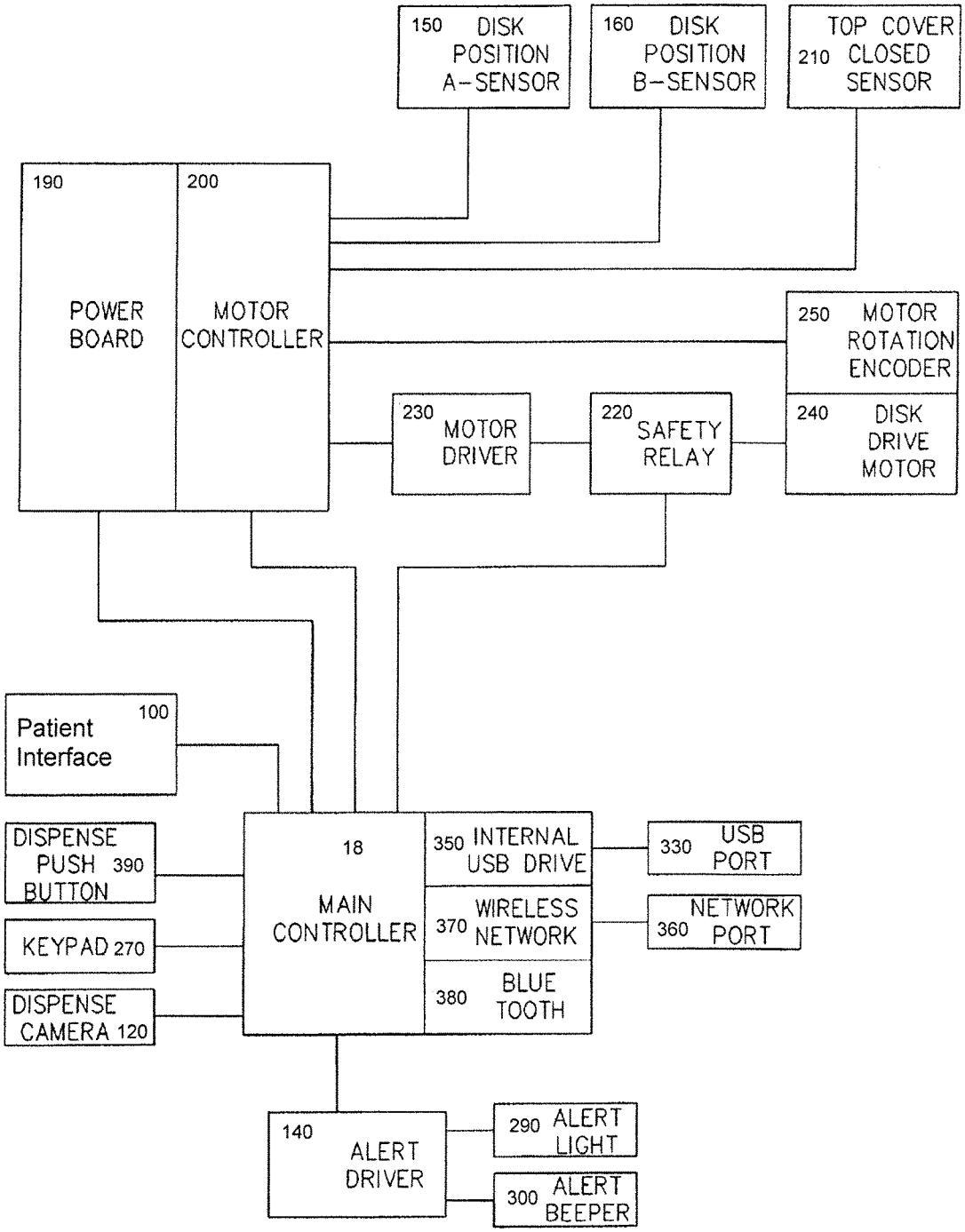
FIG. 3 shows a schematic drawing of a medication dispenser according to one embodiment of the invention.
Figure 4:
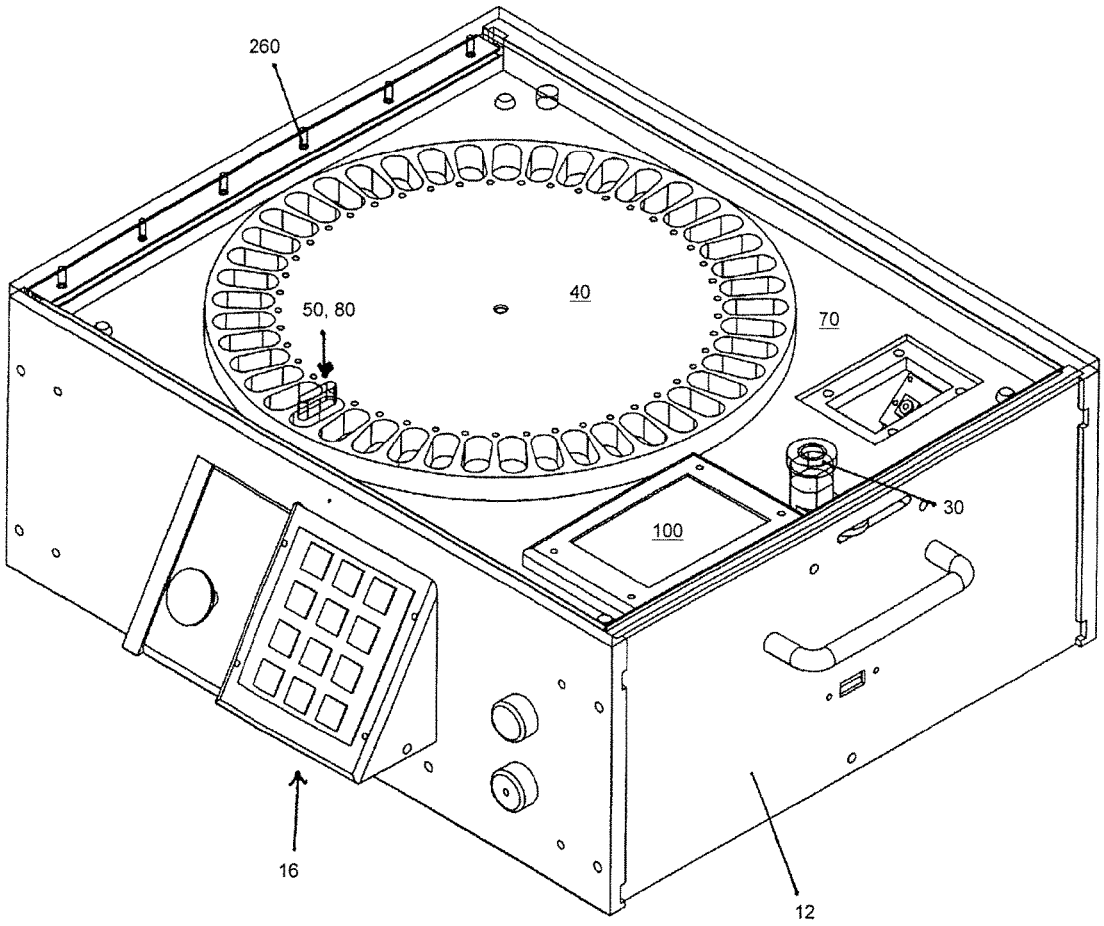
FIG. 4 illustrates a top front and side angle perspective view of a medication dispenser, with the top cover removed, according to one embodiment of the invention.
Figure 5:
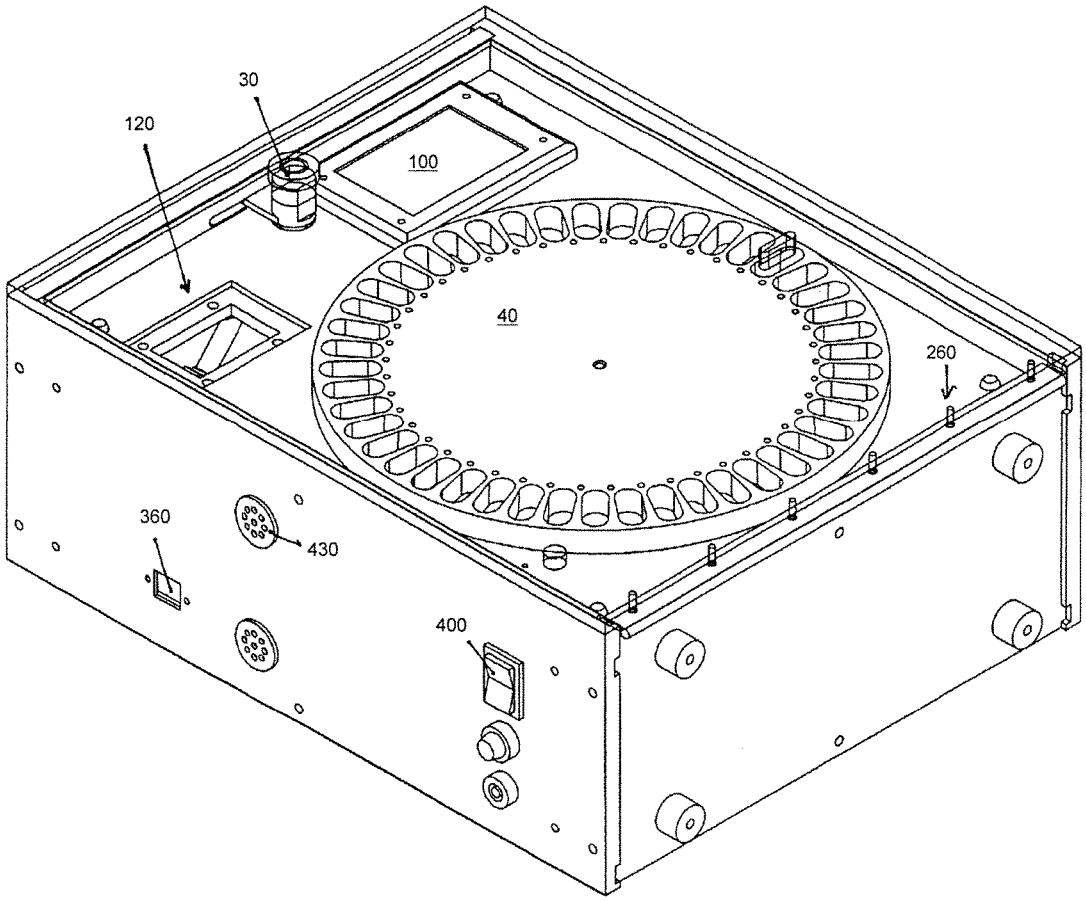
FIG. 5 illustrates a top rear and side angle perspective view of a medication dispenser, with the top cover removed, according to one embodiment of the invention.
Figure 6:
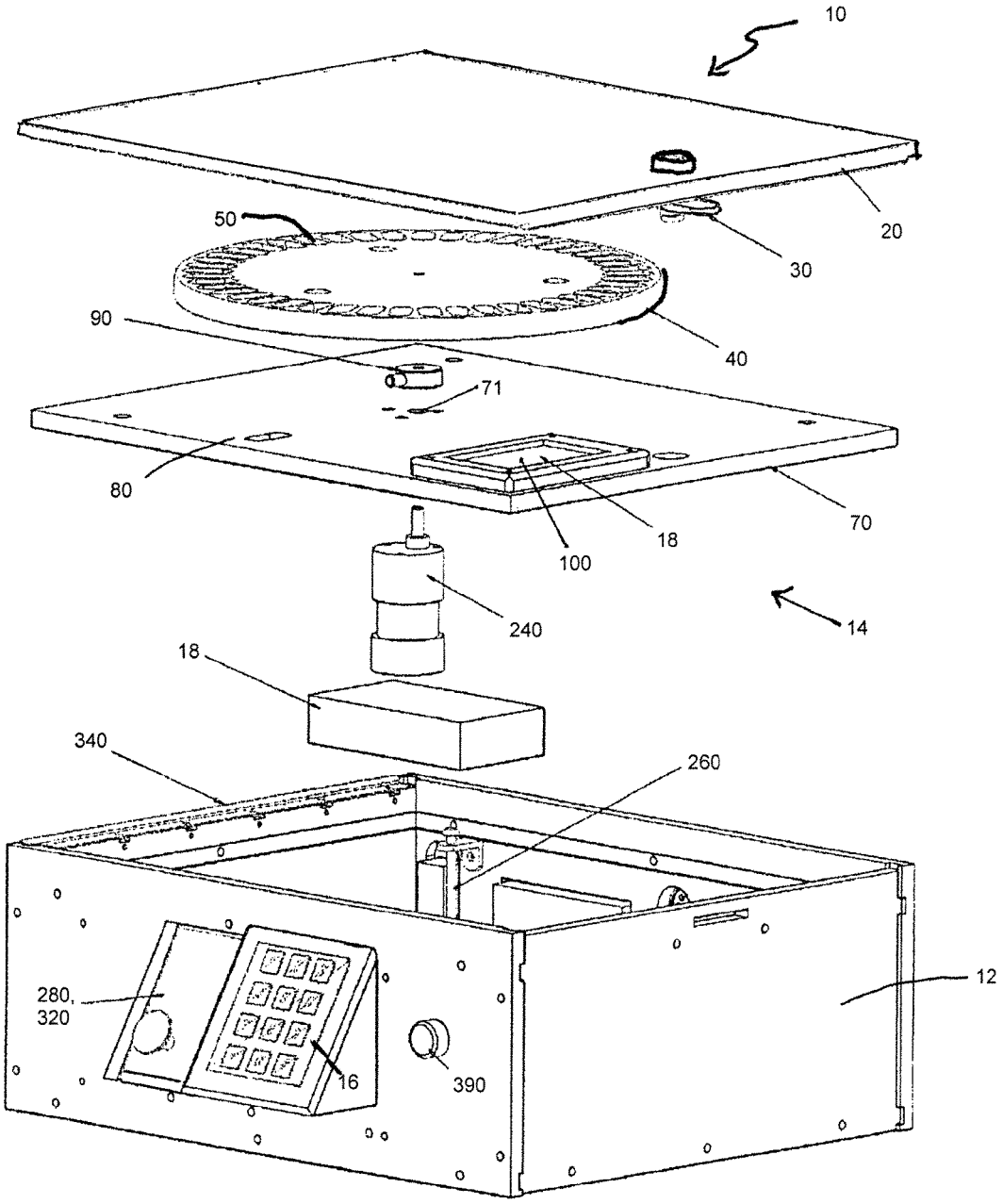
FIG. 6 illustrates an exploded top front and side angle perspective view of a medication dispenser according to one embodiment of the invention.
Figure 7:
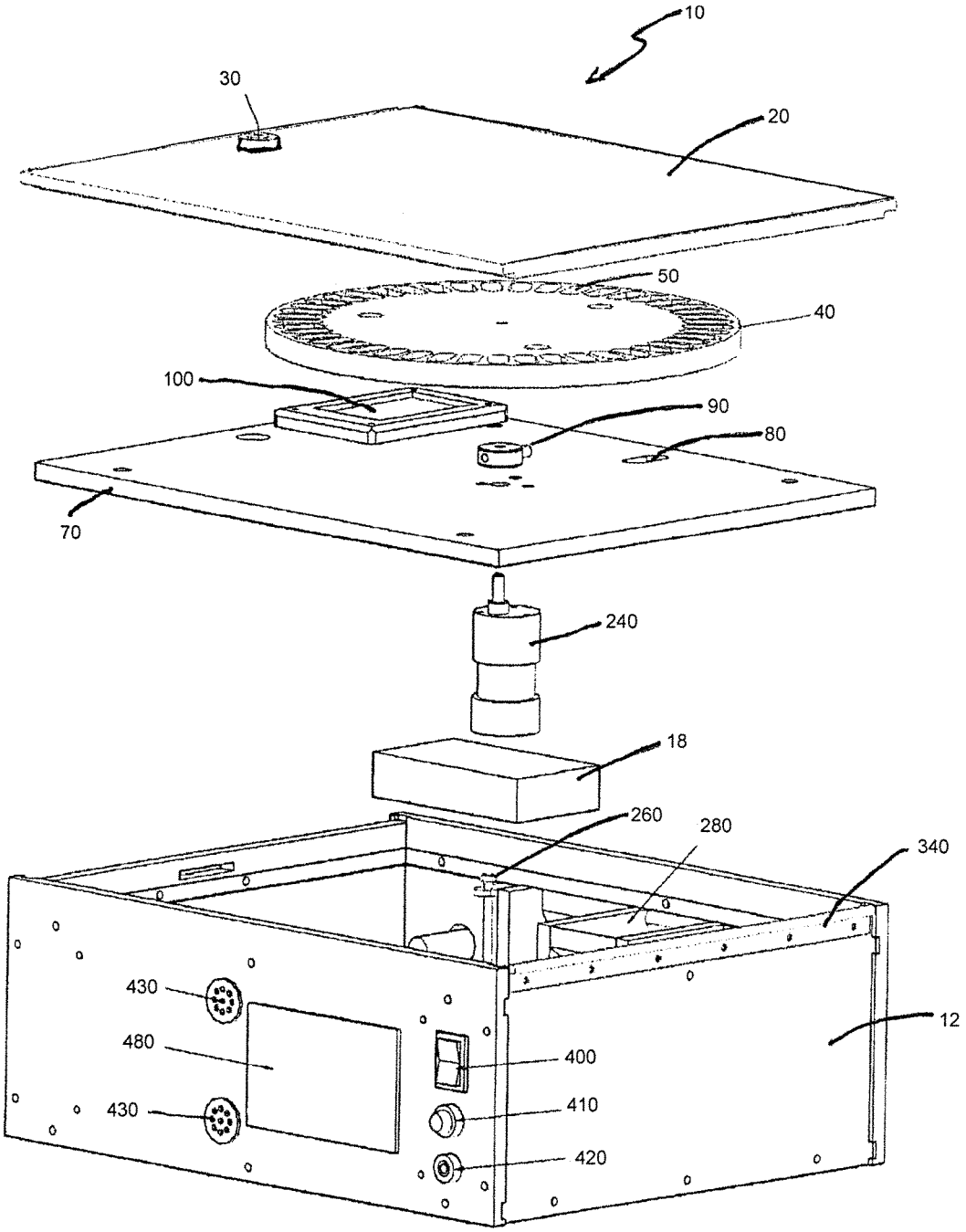
FIG. 7 illustrates an exploded bottom rear and side perspective view of a medication dispenser according to one embodiment of the invention.
Figure 8:
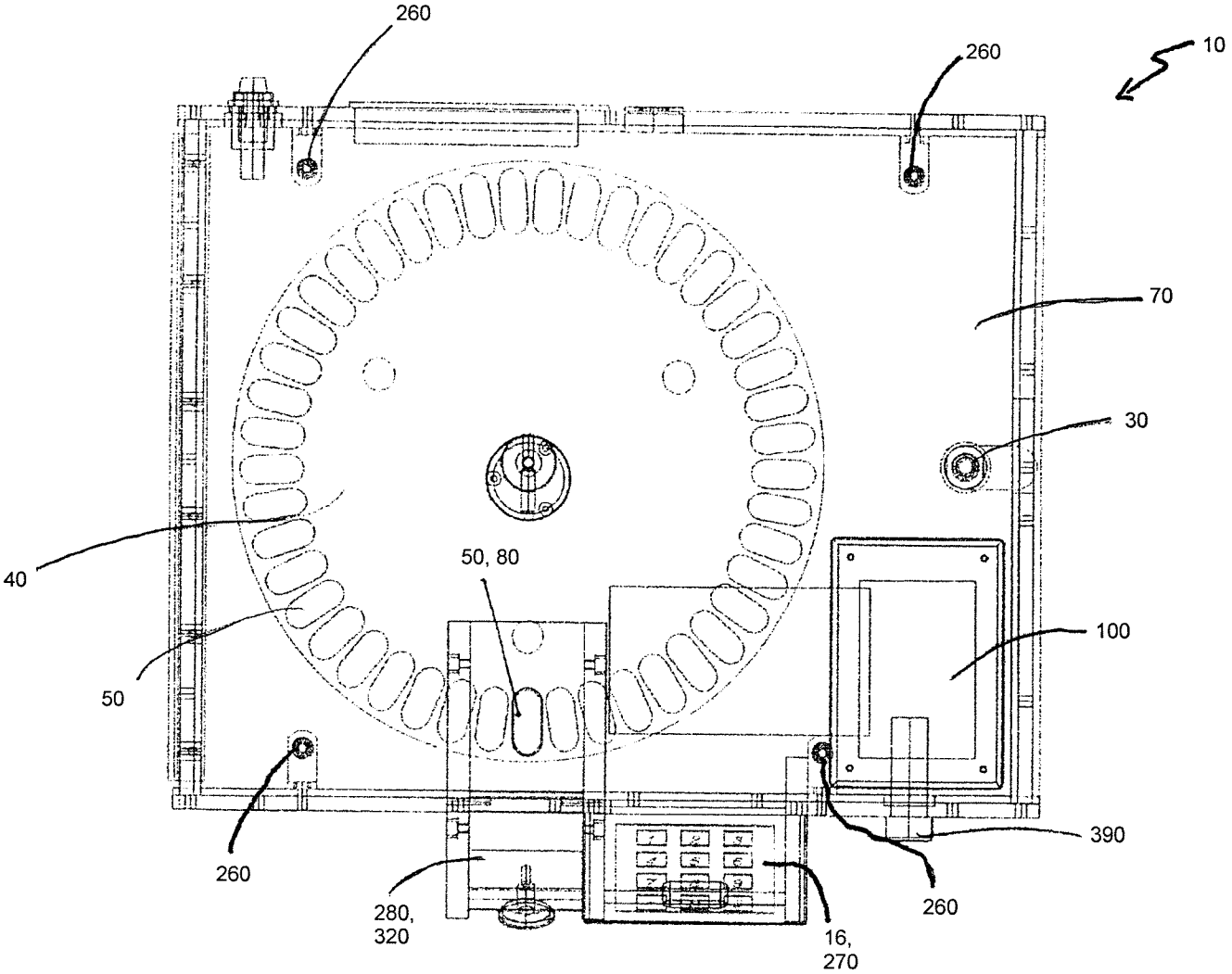
FIG. 8 illustrates a top perspective view of a medication dispenser, with the top cover removed, according to one embodiment of the invention.
Figure 9:
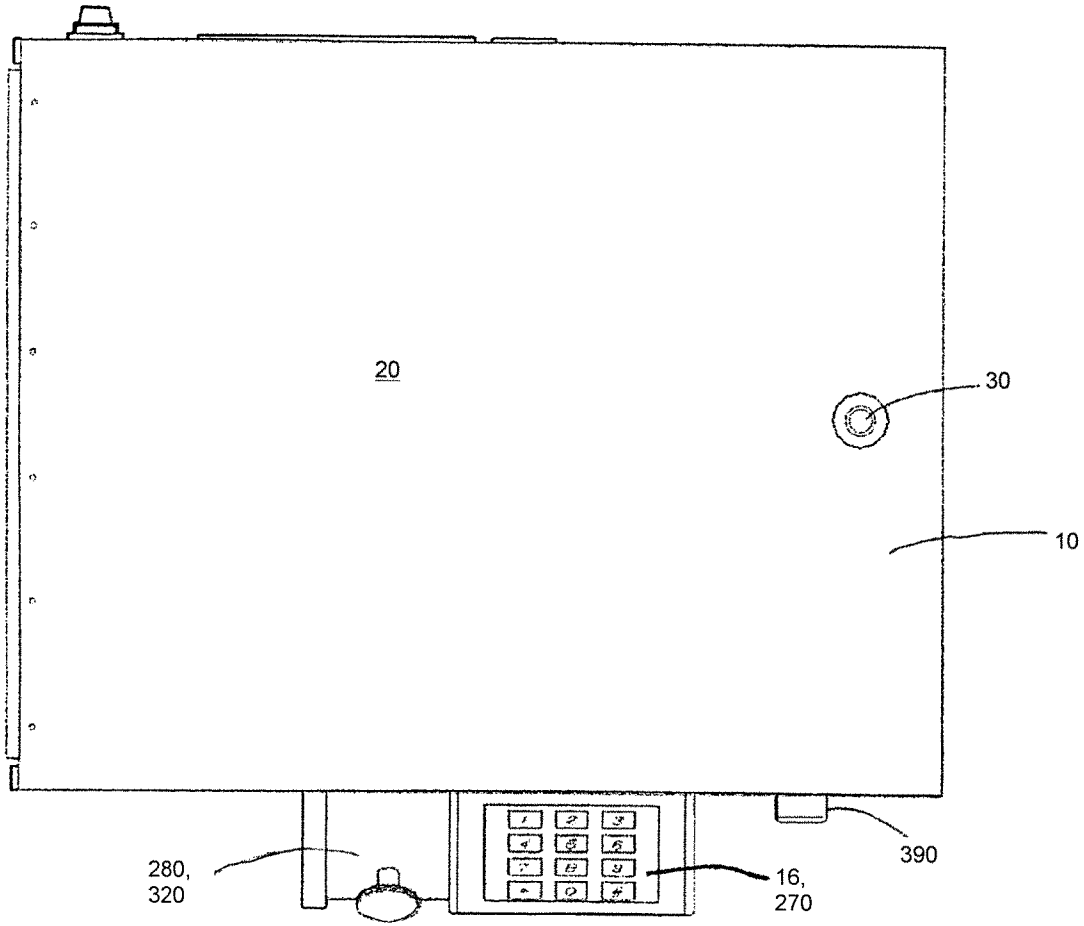
FIG. 9 illustrates a top perspective view of a medication dispenser according to one embodiment of the invention.
Figure 10:
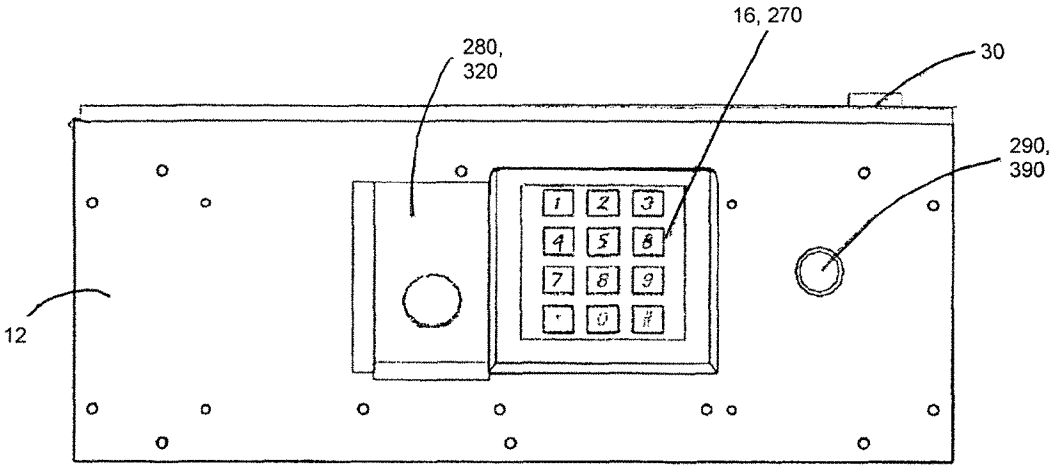
FIG. 10 illustrates a front perspective view of a medication dispenser according to one embodiment of the invention.
Figure 11:
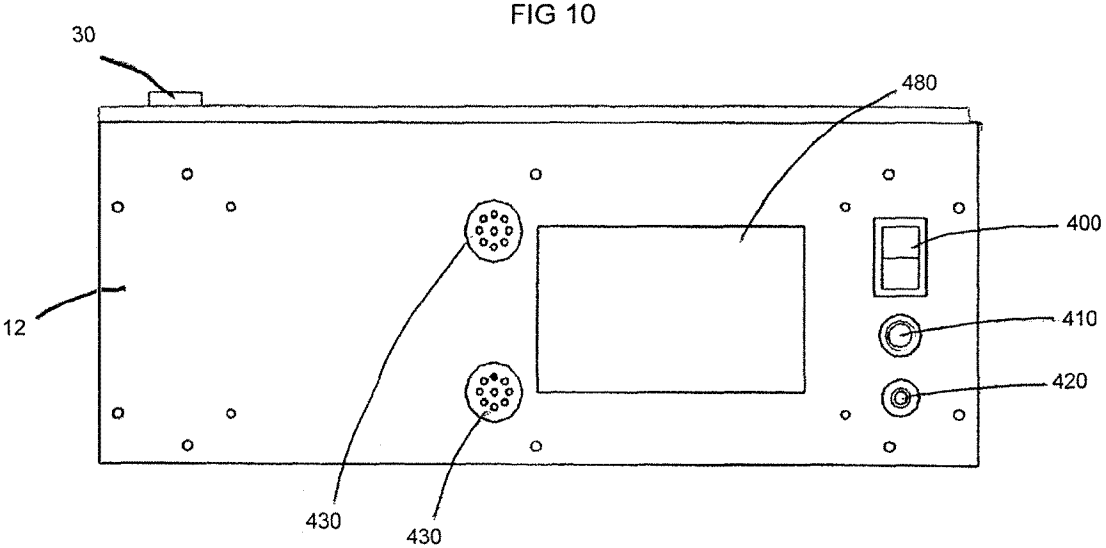
FIG. 11 illustrates a rear perspective view of a medication dispenser according to one embodiment of the invention.
Figure 12:
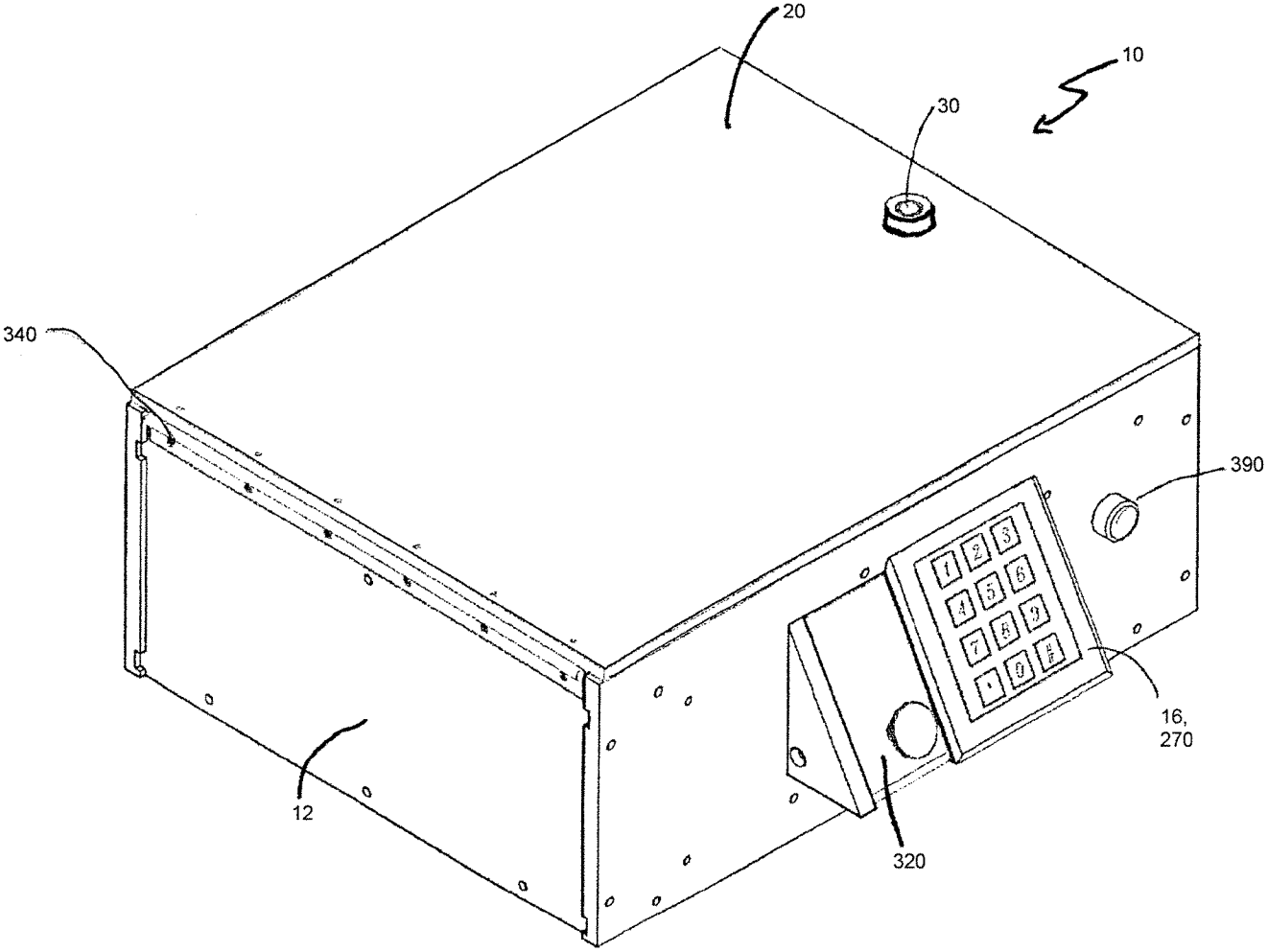
FIG. 12 illustrates a top front and side angle perspective view of a medication dispenser according to one embodiment of the invention.
Figure 13:
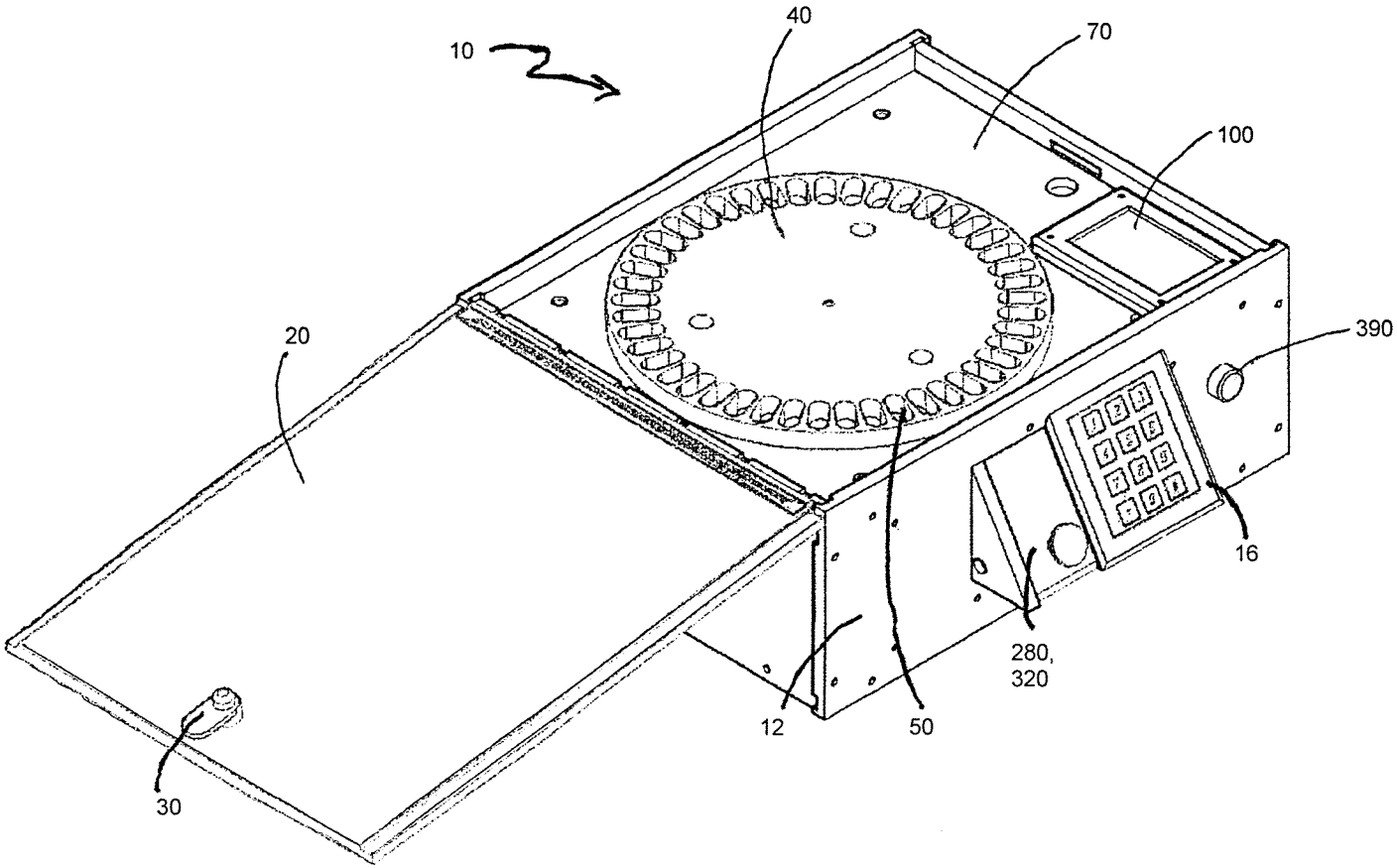
FIG. 13 illustrates a top front and side angle perspective view of a medication dispenser, with the top cover opened for a refill operation, according to one embodiment of the invention.

Movement of a pill reservoir disk 40 operatively assembled onto the support plate 70 is caused by signals generated by a controller 18. The controller 18 is in operative communication, by way of wiring or the like, as is known in the art, with at least the dispensing assembly 14 and the patient interface 16. The controller 18 may comprise one or more of a processor, microprocessor, microcontroller, system on a chip, or other such electronic componentry designed to control electronic functions. The controller 18 is configured, or programmed, to dispense medication according to patient medication prescription instructions, and may comprise, or be in control of, numerous integral or associated medication dispenser components, as is shown in FIG. 3. For example, the controller may include a timer, or associated timer module 170, that as adapted to maintain accurate date and time records even in the absence of system power. When a predetermined time interval elapses, the controller 18 may be configured to send a signal to the drive motor 240, causing rotation of the pill reservoir disk 40 of a distance that will transition the disk slot 50 containing medication from a storage position into a dispensing position above the drop chute feed hole 80, thereby causing patient medication to fall into the pill drop chute 280.

In one embodiment, once a pill is captured by the pill drop chute 280 the controller may send a signal activating the patient interface 16 for dispensing medication to the patient upon entry of a password and/or the push of an associated dispenser push button 390. In some embodiments, the patient interface 16 may comprise a keypad 270, or touch screen, that a patient may have to enter a password into in order to receive medication, or in order to activate the dispenser push button 390 for dispensing of medication. In some embodiments, the dispensing assembly 14 will not dispense medication into the pill drop chute 280 until the predetermined time interval has elapsed and the patient interface 16, and/or dispenser push button, has been activated. Once the controller 18 or timer module 170 determines a predetermined time period has elapsed the timer will be reset and another medication dispensing event scheduled; in other embodiments, however, the timer will only reset after both a predetermined time period has elapsed and the patient interface 16, and/or dispenser push button 390, is accessed by the patient and medication is dispensed. In one embodiment, the dispenser push button 390 may also comprise, or be in working relationship with, an alert light 290 indicating to the patient that medication is available for receipt upon activation of the dispenser push button 390, or (if the controller's security functions are turned on) upon entry of a security code followed by activation of the dispenser push button 390. In yet another embodiment, the controller 18 may send a signal to an associated alert beeper 300 that is configured to generate an audible signal when medication is available for receipt. In some embodiments, the alert light 290 and alert beeper 300 may be adapted to provide signals regarding a fault condition. The pill drop chute 280 may be selectively inaccessible by way of a pill drop chute door 320; in one embodiment, the pill drop chute door 320 may additionally comprise a lock assembly which may only be opened after a security code is entered into the patient interface 16 or keypad 270; in other versions, the pill drop chute door 320 may be opened at any time, or only after the dispenser push button 390 is activated and/or depressed.

Importantly, the medication dispenser 10 situates both the dispensing assembly 14 and controller 18 in a location that is inaccessible to the patient but is selectively accessible to a caregiver. In some embodiments, the controller may be seated entirely below the support plate 70, and may be accessible to an authorized caregiver by way of wireless communication signals. In other embodiments, generally shown in FIGS. 1-2 and 4-13, the controller 18 may comprise a caregiver interface 100, such as a touch screen or key pad, mounted onto the top surface of the support plate 70 in a manner that is inaccessible when the top cover 20 is secured in place, but is selectively accessible when the locking mechanism 30 is disabled to permit opening of the cover 20.

The controller 18, and/or caregiver interface 100, may be configured with logic that can determine medication dispenser 10 settings or status, receive medication dispensing and refill instructions, or provide the caregiver with information about medication dispensing history or settings. For example, the pill reservoir disk 40 may contain one hundred disk slots 50 adapted to receive a patient's pain medication; when one hundred pills are dispensed to the patient, the medication dispenser 10 is in need of refill; the controller 18 or caregiver interface 100 may be configured to recognize the necessity of a medication refill, reset the timer or timer module, and/or permit a caregiver to effectuate a medication refill while viewing or modifying dispensing parameters. As shown in FIG. 3, the controller 18, and/or patient interface 100, may also be in operative communication with one or more medication dispenser components configured to monitor medication dispenser 10 functions for patient compliance, status, or fault conditions.

The controller may have internal, or associated, storage devices 350 such as an internal USB drive, or the like, configured to store all machine operation parameters, faults, dispensing history and camera history. The controller 18, and/or caregiver interface 100, are configured to receive, execute and/or display operation instructions such as: viewing and or resetting the dispenser after fault conditions; changing the time remaining before the next dose of pills can be dispensed; viewing and/or changing the minimum time between doses; turning on and off alert light 290 or alert beepers 300; turning on, off, or changing patient interface 16 security features or passwords; programming the controller 18 for step down options that will increase the duration of predetermined time periods before the next dispensing event can occur; setting time and date for time stamping dispense and camera history; turning on or off the camera 120; permitting viewing, transferring, or deletion of camera 120 history or images; view and respond to fault conditions; purging medication contained in the dispensing assembly 14; and/or transferring dispensing history information to external storage devices, such as an external USB device or other storage medium.

The controller, and/or caregiver interface 100, may be configured to be in operative wired or wireless communication with an associated electronic device such as a mobile phone, tablet, laptop computer, personal computer, keyboard, mouse or storage device. In one embodiment, the controller 18 may have a wired network port 360 configured to connect the medication dispenser 10 to a wired network, such as by Ethernet connection, for the purpose of viewing or changing dispenser operation parameters, faults, dispensing history and camera history. In another embodiment, the controller 18 may have a wireless network module 370 configured to connect the medication dispenser 10 to a wireless network for the purpose of viewing or changing dispenser operation parameters, faults, dispensing history and camera history. In still other embodiments, the controller 18 may have a Bluetooth® module 380 configured to connect the medication dispenser 10 to a mobile phone, tablet or computer for the purpose of viewing or changing dispenser operation parameters, faults, dispensing history and camera history. In one embodiment, the controller 18 may have an associated external USB port 330, or the like, adapted to transfer or receive instructions from an associated keyboard, phone, computer, or storage device regarding dispensing instructions and/or camera history.

The controller 18 may also be in communication with an associated camera 120; when a predetermined time period elapses, and the patient interface 16 is manipulated by the patient to dispense medication, the controller 18 may recognize that a dispensing event has occurred and activate the camera 120 for a specific amount of time to, for example, capture images confirming that the patient has ingested the medication, or ensure that the medication has not been received by an unauthorized third party. In various embodiments, the camera 120 may be mounted on locations outside the housing 12 (not shown). Alternatively, the camera 120 may be mounted onto the support plate 70, with the assistance of a camera mount 130 and/or camera cover 110; in some related versions the top cover 20 may be translucent.

In some embodiments, the medication dispenser 10 may contain various arrangements of components adapted to effectuate a secure and reliable medication dispensing event. For example, the controller 18 may be in operative communication with one or more disk position sensors 150, 160 that are mounted to the support plate 70 and adapted to verify movement and position of the pill reservoir disk 40; movement of the pill reservoir disk 40 being tracked based on toggling of the sensors 150, 160 based on their position relative to magnets 60 disposed on or within the pill reservoir disk 40; while in some embodiments, the disk location sensors 150, 160 also verify the operation of each other. In other embodiments, a top cover closed sensor 210 may detect when the top cover 20 is closed, thereby signaling that the controller 18 should disable to touch screen caregiver interface 100 or that a dispensing event should not begin until the top cover 20 is closed. A motor rotation encoder 250 may be adapted to verify that the drive motor 240 is rotating in order to detect a fault condition such as stalled or jammed motor 240 or pill reservoir disk 40. The motor rotation encoder 250 may also be configured to attempt to clear the stall or jam, to verify the operability of the disk location sensors 150, 160, and/or to determine how far the pill reservoir disk 40 has rotated. In still other embodiments, the controller 18 may include, or work with, an associated motor controller 200 adapted to monitor fault conditions identified by the motor rotation encoder 250, monitor the disk location sensors 150, 160, and/or monitor the top cover closed sensor 210 before sending signals to activate the drive motor 240 for rotation of the pill reservoir disk 40.

Power to the medication dispenser 10 is provided through means well known in the art. This may include use of a power supply input 420, such as a 12 vdc power supply input receptacle (and associated cord, not shown). A fuse holder 410, and associated fuse, may prevent against power overload. A power board 190, may be utilized to provide power to various medication dispenser 10 components, and/or to provide reserve power to complete a dispensing event if power through wired channels is lost. The motor controller 200 may utilize a motor driver 230 to provide power to the drive motor 240 upon receipt of instructions from the controller 18 to rotate the pill reservoir disk 40. The controller 18 may also cooperate with an alert driver 140 to supply power to the alert light 290 and alert beeper 300 when medication is ready to be dispensed to the patient by way of the patient interface and/or the dispense push button 390. And a safety relay 220, controlled by the controller 18, may be incorporated to prevent, or stop, rotation of the pill reservoir disk 40 in the event of a fault condition, thereby providing secondary safety features in the event that the motor controller 200 or the motor driver 230 fail. Finally, a power switch 400 is used to turn the medication dispenser power on and off.

In operation, in one embodiment the medication dispenser 10 may be configured or programmed to dispense medication in an as-needed time controlled manner. Thus, medication is available for dispensing only after the controller 18, or timer module 170, has a predetermined time period elapse and the patient interface, and/or dispense push button 390, has been activated. Only after the dispense push button 390 has been activated will the timer reset to the predetermined time period. It is not necessary that the patient dispense medication after the timer has run out and the patient interface and/or the dispense push button has been activated to permit final receipt of medication; however, the medication dispenser will not reset the timer until medication has actually been received by the patient (as compared to resetting the timer once the medication is captured in the pill drop chute 280).

By way of example, if the patient is prescribed a pain medication for ingestion every four hours, then a caregiver may be provided with the necessary medication and means, such as a key or pass code, to access the medication dispenser housing 12. The caregiver could then fill the medication disk slots 50 and enter confirmation of a medication refill into the controller 18 or caregiver interface 100 along with specific dispensing parameters or instructions. Having properly programmed the medication dispenser according to a physician's or pharmacist's instructions, four hours after the last medication dispensing event (or, in this case, refill) the controller 18 will determine that the predetermined time interval has passed and send a signal to the patient interface 16, dispense push button 390, alert light 290 and/or alert beeper 300 indicating that a patient may take the final steps necessary to receive medication. The controller 18 does not reset the timer and begin a new medication dispensing event cycle, however, until the patient interface 16, and/or dispenser push button 390, is activated. Once the patient activates the patient interface 16 and/or dispenser push button 390, the controller 18 will reset the timer and send a signal to activate the motor 240, thereby rotating the pill reservoir disk 40 into a position where a disk slot 50 containing medication is aligned over a pill drop chute hole 80, resulting in a pill being captured and retained within the pill drop chute 280. The patient may then access the medication by retrieving it from the pill drop chute 280, or by opening the door 320 obstructing the pill drop chute 280. The patient interface 16, or keypad 270, may require entry of a password or passcode to prevent children or other unauthorized persons from dispensing medication. After the patient activates the patient interface 16, and/or dispenser push button 390, the alert light and beeper may be disabled, and the medication dispensing event timer reset, thereby reinitiating a cycle where the medication dispenser 10 will continue to dispense medication contained in disk slots 50 until they are empty and a refill is necessary.

Over time, step down functions programmed into the controller 18 may selectively increase the time period between medication dispensing events to gradually reduce a patient's intake of potentially addictive medications. The controller's ability to keep a history of date and time-stamped dispensing events lets a physician or other caregiver monitor compliance with prescription instructions. Compliance with prescription instructions, and/or preventing unauthorized persons from accessing medication can be supported by the dispenser camera 120.

While the claimed subject matter of the present application has been described with reference to certain embodiments, it will be understood by those skilled in the art that various changes may be made and equivalents may be substituted without departing from the scope of the claimed subject matter. In addition, many modifications may be made to adapt a particular situation or material to the teachings of the claimed subject matter without departing from its scope. Therefore, it is intended that the claimed subject matter not be limited to the particular embodiments disclosed, but that the claimed subject matter will include all embodiments falling within the scope of the appended claims.

What is claimed is:

1. A medication dispenser comprising:

a housing, adapted to securely retain patient medication and be selectively accessible by a caregiver, the housing comprising a top cover and a locking mechanism, the top cover being adapted to provide selective access to components residing within the housing, and the locking mechanism being adapted to retain the top cover in a closed position until a caregiver obtains said selective access and moves the top cover into an open position;

a dispensing assembly, situated within the housing and selectively accessible by a caregiver for medication refill, the dispensing assembly comprising a support plate with a drop chute feed hole, a pill reservoir disk operatively seated onto the support plate and having one or more magnets and a plurality of disk slots adapted to selectively retain medication, a disk drive motor operatively connected to the pill reservoir disk and adapted to rotate the pill reservoir disk slots between storage and dispensing positions, and a pill drop chute operatively situated below the drop chute feed hole and adapted to move medication retained within the housing into a position accessible to a patient, wherein medication is selectively dispensed to the patient when a slot containing medication is moved into a dispensing position above the drop chute feed hole;

a controller, situated within the housing, in operative communication with the dispensing assembly and selectively accessible by a caregiver, comprising a top cover sensor adapted to determine whether the top cover is in an open or closed position and disable a caregiver interface when the top cover is in a closed position, one or more disk position sensors, a motor controller adapted to monitor the top cover sensor and use the magnets and disk position sensors to monitor the location and movement of the pill reservoir disk to determine if a fault condition has occurred and to activate the drive motor when the top cover is closed and no fault conditions exists, and the caregiver interface adapted to receive medication dispensing and refill instructions; and a patient interface adapted to dispense medication to the patient;

wherein the controller is selectively inaccessible to the patient and adapted to activate the patient interface for dispensing of medication according to caregiver instructions.

2. The medication dispenser of claim 1, wherein:

the housing additionally comprises a top cover hinge, and the top cover is secured to said top cover hinge by way of anti-tamper fasteners;

and the locking mechanism comprises a lock and key arrangement adapted to permit selective movement of the top cover into an open position.

3. The medication dispenser of claim 1, wherein the dispensing assembly additionally comprises a disk drive hub, said disk drive hub being operatively seated within a recess on the bottom side of the pill reservoir disk and adapted to operatively connect to the drive motor.

4. The medication dispenser of claim 1, wherein the housing additionally comprises a pill drop chute door, said drop chute door being operatively connected to the pill drop chute and adapted to open to provide a patient access to dispensed medication.

5. The medication dispenser of claim 1, wherein the controller additionally comprises a motor rotation encoder adapted to verify pill reservoir disk rotation and rotation length.

6. The medication dispenser of claim 1, wherein the controller additionally comprises a safety relay adapted to control the disk drive motor in the event of a fault condition.

7. The medication dispenser of claim 1, additionally comprising a camera adapted to capture images according to predetermined instructions when a dispensing operation is triggered.

8. The medication dispenser of claim 1, wherein the controller is programmed to activate the patient interface after a predetermined time interval has elapsed, and wherein the patient interface only dispenses medication to a patient after a predetermined password is entered.

9. The medication dispenser of claim 8, wherein the controller is programmed to increase the time interval between medication dispensing events based on a predetermined schedule.

10. The medication dispenser of claim 8, wherein the controller is accessible by electronic signals communicated by means selected from the group consisting of wired network ports, wireless network modules, or Bluetooth® modules.

11. The medication dispenser of claim 8, wherein the controller additionally comprises an internal storage device adapted to store medication dispenser instructions, faults, dispensing history and images captured from an associated camera.

* * * * *